US009222244B2

(12) United States Patent
Holt

(10) Patent No.: US 9,222,244 B2
(45) Date of Patent: Dec. 29, 2015

(54) WALL FAUCET MOUNTING SLEEVE APPARATUS AND METHOD

(71) Applicant: Michael V. Holt, Covington, KY (US)

(72) Inventor: Michael V. Holt, Covington, KY (US)

( * ) Notice: Subject to any disclaimer, the term of this patent is extended or adjusted under 35 U.S.C. 154(b) by 100 days.

(21) Appl. No.: 14/078,780

(22) Filed: Nov. 13, 2013

(65) Prior Publication Data

US 2014/0131545 A1 May 15, 2014

Related U.S. Application Data

(60) Provisional application No. 61/726,144, filed on Nov. 14, 2012.

(51) Int. Cl.
*F16L 5/00* (2006.01)
*E03B 9/02* (2006.01)

(52) U.S. Cl.
CPC ..... *E03B 9/025* (2013.01)

(58) Field of Classification Search
USPC ..... 248/56; 137/359, 360
See application file for complete search history.

(56) References Cited

U.S. PATENT DOCUMENTS 572,911 A * 12/1896 Schmidt ..... 285/46
1,672,605 A * 6/1928 Dobrick ..... 248/56
2,496,520 A * 2/1950 Daniel ..... 239/208
4,309,007 A * 1/1982 Logsdon ..... 248/56
4,473,244 A * 9/1984 Hill ..... 285/14
4,626,620 A * 12/1986 Plyler ..... 174/153 G
4,739,596 A * 4/1988 Cunningham et al. ..... 52/220.8
4,821,762 A 4/1989 Breneman
5,211,695 A * 5/1993 Dowler ..... 285/140.1
5,842,499 A * 12/1998 Hall ..... 137/360
6,140,582 A * 10/2000 Sheehan ..... 174/669
6,352,224 B1 * 3/2002 Collins ..... 248/73
6,668,852 B1 * 12/2003 Williamson ..... 137/312
RE38,881 E * 11/2005 Chubb et al. ..... 248/231.9
7,465,888 B2 * 12/2008 Fischer et al. ..... 174/655
7,891,088 B2 * 2/2011 Robinett et al. ..... 29/828
8,151,821 B2 * 4/2012 Ball ..... 137/359
8,281,800 B2 * 10/2012 Ball et al. ..... 137/359
2010/0180375 A1 * 7/2010 Meehan et al. ..... 4/695

OTHER PUBLICATIONS

Woodford Mounting Sleeve, Mounting Sleeve Installation Instructions by Woodford, printed from PlumbingSupply.com, Jul. 11, 2012.

(Continued)

*Primary Examiner* — Bradley Duckworth
(74) *Attorney, Agent, or Firm* — Frost Brown Todd LLC

(57) ABSTRACT

A multi-piece wall faucet mounting sleeve that includes a tube and flange assembly having a longitudinal axis and a tube, and that includes a mounting bracket assembly configured to telescopically receive a portion of the tube and flange assembly such that the mounting bracket assembly is slidingly disposable about the tube of the tube and flange assembly. In addition, the components are configured such that the mounting bracket of the mounting bracket assembly is non-perpendicular to the longitudinal axis of the tube of the tube and flange assembly when they are assembled together. Thus, the tube integrally provides a downward fall, or natural drain angle, with respect to a wall surface when assembled to the mounting bracket assembly, which fall allows for water to drain from a faucet, such as a freezeless faucet, disposed in the tube. Further, the tube is easily assembled and adjustable within and lockable to the mounting bracket assembly even after the mounting bracket assembly is disposed about the tube.

20 Claims, 16 Drawing Sheets

(56) References Cited

OTHER PUBLICATIONS

The Home Depot, Product Specifications, DBHL 1 ½ in. × ¾ in. Flexible Rubber Coupling. [downloaded from http://www.homedepot.com/p/DBHL-1-1-2-in-x-3-4-in-Flexible-Rubber-Coupling-HD7983C/100345440?keyword=DBHL+1-1%2F2+in.+x+3%2F4+in.+Flexible+Rubber+Coupling on Aug. 4, 2015—publication date unknown.].

* cited by examiner

FRONT
TOP

WALL FAUCET MOUNTING SLEEVE APPARATUS AND METHOD

PRIORITY

This application claims priority to U.S. Provisional Patent Application Ser. No. 61/726,144, filed Nov. 14, 2012, entitled "Wall Faucet Mounting Sleeve Apparatus and Method," the disclosure of which is incorporated by reference herein.

BACKGROUND

Wall faucets may be found on home exteriors. An outdoor wall faucet assists with outdoor plumbing needs such as providing water to a garden hose that is attachable to the wall faucet. Wall faucets may be built into a home exterior upon a home construction, as described below. Wall faucets are known, as disclosed in U.S. Pat. No. 4,821,762, entitled "Freezeless Wall Faucet Having Removable Cartridge," issued Apr. 18, 1989.

Multi-component wall faucet mounting sleeves are known, which sleeves are securable to a wall surface and are non-adjustable after such wall surface securement. An example of a known mounting sleeve is the Woodford mounting sleeve provided by Woodford Manufacturing Company, Colorado Springs, Colo.

The present disclosure describes embodiments of an easily installable multi-piece wall faucet mounting sleeve that is adjustable after securement to a wall surface.

BRIEF DESCRIPTION OF THE DRAWINGS

While the specification concludes with claims which particularly point out and distinctly claim the invention, it is believed the present invention will be better understood from the following description of certain examples taken in conjunction with the accompanying drawings, in which like reference numerals identify the same elements and in which:

Figure 4:
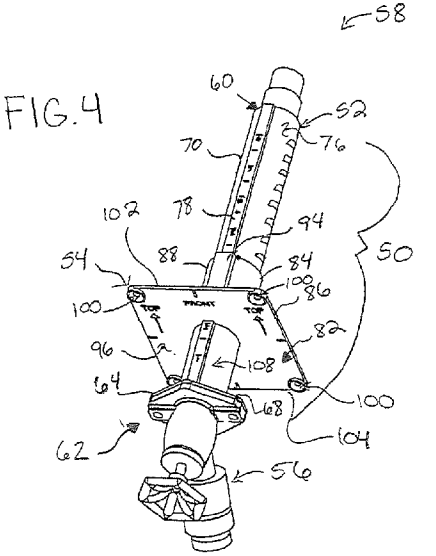
FIG. 4 depicts a top perspective view of the exemplary sleeve and faucet assembly of FIG. 1.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description. As will be realized, the invention is capable of other different and obvious aspects, all without departing from the invention. Accordingly, the drawings and descriptions should be regarded as illustrative in nature and not restrictive.

Wall faucets are useful for outdoor purposes, such as providing water from an indoor or underground source to an outdoor area. Wall faucets attached to buildings or constructions such as homes, for example, generally project from an exterior surface of the building. The wall faucets may be connected to indoor plumbing of the building, for example, to provide water from the indoor source to an area outside of the building. A garden hose, for example, may be attached to the faucet, or a bucket may be placed under the faucet to collect liquid such as water outside of the building.

The present application discloses embodiments of a multi-piece wall faucet mounting sleeve that includes a tube and flange assembly having a longitudinal axis and a mounting bracket assembly configured to telescopically receive a portion of the tube and flange assembly such that the mounting bracket assembly is slidingly disposable about a tube of the tube and flange assembly. When the mounting bracket assembly is disposed about the tube, a mounting bracket of the mounting bracket assembly is non-perpendicular to the longitudinal axis of the tube. Thus, the tube integrally provides a downward fall, or natural drain angle, with respect to a wall surface when assembled to the mounting bracket assembly. Further, the tube is easily assembled and adjustable within and lockable to the mounting bracket assembly even after the mounting bracket assembly is disposed about the tube. The sleeve, and in particular a front flange of the tube and flange assembly, is compatible with and able to securely receive a wide range of faucets, such as freezeless faucets, from a variety of companies to form a sleeve and faucet assembly for installation within a portion of a wall. An installer may easily assemble the sleeve and install the reliable sleeve to a wall surface.

Through this description, the terms "rear," "front," "top," "bottom," and "side" are used to describe views of components as seen with respect to a wall surface when the sleeve and faucet assembly is received in a wall surface.

Referring to FIGS. 1-4, two-piece wall faucet mounting sleeve 50 (separately shown without a faucet 56 in FIGS. 19-22) includes tube and flange assembly 52 (separately shown in FIGS. 5-10) and mounting bracket assembly 54 (individually shown in FIGS. 11-18). Tube and flange assembly 52 is telescopically received and adjustable within mounting bracket assembly 54, which is selectively lockable to tube and flange assembly 52, as described further below. Sleeve 50 is sized and configured to receive a faucet, such as freezeproof faucet 56, to form sleeve and faucet assembly 58, which is shown in FIGS. 1-4. Sleeve 50 may be made of plastic such as polyvinyl chloride (PVC) and/or other suitable materials as will be apparent to those of skill in the art in view of the teachings herein.

Referring to FIGS. 5-10, tube and flange assembly 52 includes rear end 60 and an opposite front end 62. Flange 64 is disposed at front end 62 and includes a faucet mounting surface 66 and an opposing rear surface 68. Flange 64 includes a pair of fastening apertures 69 that are sized and configured to receive fasteners, such as screws, to connect flange 64 to faucet 56. Tube 70 has a generally tubular shape and extends between flange 64 and rear end 60. As shown, faucet 56 includes a faucet tube 57 and a rear end 72 of faucet tube 57 is receivable in aperture 74 of tube and flange assembly 52, which aperture 74 is sized and shaped to receive faucet tube 57. Aperture 74 provides an opening to channel 75 that is defined by interior walls of tube 70 and by interior walls of flange 64.

Tube 70 includes a longitudinal axis and exterior surface 76. As shown FIGS. 1-10, along a first length of exterior surface 76, tube 70 includes key 78 that includes markings. For example, key 78 may include markings showing a measurement of inches and be an increasing (or decreasing) scale upon which to measure positioning of mounting bracket assembly 54 with respect to front end 62 when mounting bracket assembly 54 is attached to front end 62 of tube and flange assembly 52. The scale may measure, for example, up to 8 inches separated in half inch increments and labeled in inch increments from front end 62 to rear end 60. Opposite sides of tube 70 below key 78 each include female detents 79 positioned in increments (e.g., at half inch increments) that correspond with the markings of key 78. A groove 80 defining an interior surface of key 78 rearwardly extends from a top portion of aperture 74 along substantially the entire length of key 78. In the illustrated embodiment, groove 80 has a substantially square or rectangular cross section.

Referring to FIGS. 11-18, mounting bracket assembly 54 includes front end 82, rear end 84, mounting bracket 86 disposed at front end 82, and bracket tube 88 extending rearwardly from mounting bracket 86 and disposed between mounting bracket 86 and rear end 84. Aperture 90 opens into channel 91 that is defined by walls of mounting bracket 86 and of bracket tube 88. In use, bracket tube 88 slidingly receives tube 70 within channel 91, as described further below.

As shown in FIGS. 11-18, on top of channel 91, bracket groove 92 rearwardly extends from a top portion of aperture 90 and is defined by the interior walls forming bracket key 94 of mounting bracket assembly 54. Channel 91 is sized to slidingly receive tube 70 of tube and flange assembly 52, and bracket groove 92 is sized to receive key 78 of tube and flange assembly 52. Opposite side ends of bracket tube 88 below bracket key 94 may each comprise a resiliently biased member such as a locking finger ending in a male detent or catch 81 configured for receipt within respective female detent or notch 79 disposed below key 78 of tube and flange assembly 52 when tube 70 of tube and flange assembly 52 is received within channel 91 of mounting bracket assembly 54. Tube 70 may be urged in either a forward or backward direction, sliding each male detent 81 of the pair of male detents 81 away from a respective first female detent 79 toward another second female detent 79, and allowing for the adjustment of tube 70 within mounting bracket assembly 54. As each male detent 81 is received within a respective female detent 79, the mating detents click into place to provide a locking feature that adjustably locks mounting bracket assembly 54 to tube and flange assembly 52 to form assembled mounting sleeve 50.

Figure 1:
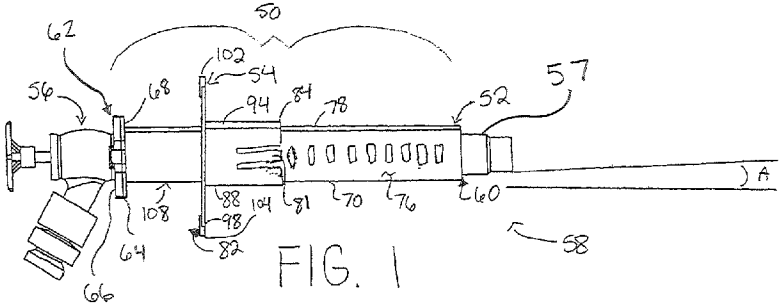
FIG. 1 depicts a side elevation view of an exemplary sleeve and faucet assembly.
Figure 2:
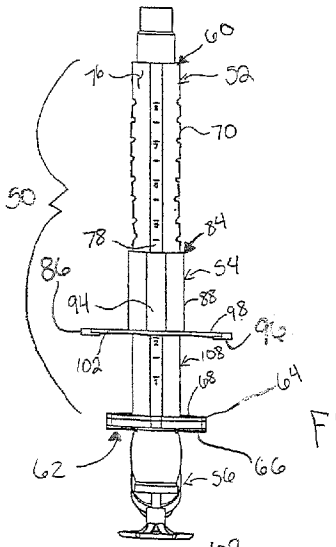
FIG. 2 depicts a top plan view of the exemplary sleeve and faucet assembly of FIG. 1.
Figure 3:
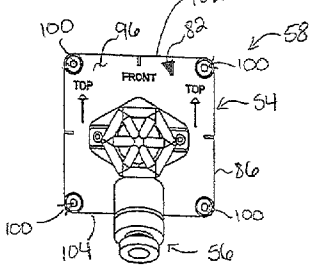
FIG. 3 depicts a front elevation view of the exemplary sleeve and faucet assembly of FIG. 1.
Figure 10:
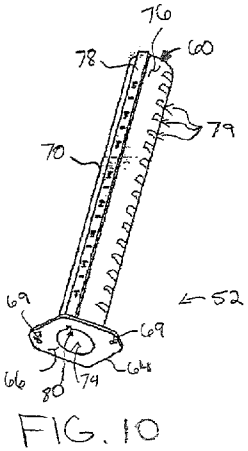
FIG. 10 depicts a top perspective view of the exemplary tube and flange assembly of FIG. 5.
Figure 9:
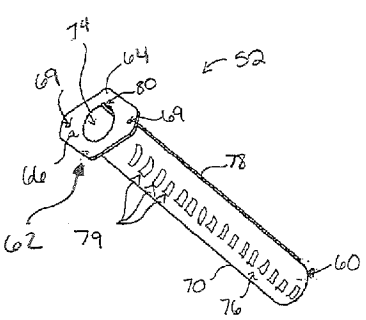
FIG. 9 depicts a bottom perspective view of the exemplary tube and flange assembly of FIG. 5.
Figure 8:
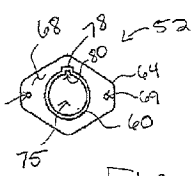
FIG. 8 depicts a rear elevation view of the exemplary tube and flange assembly of FIG. 5.
Figure 5:
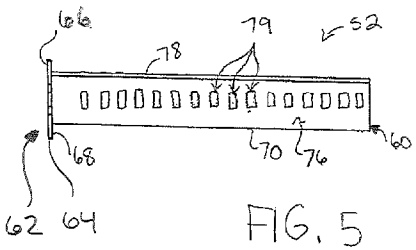
FIG. 5 depicts a side elevation view of an exemplary tube and flange assembly of the exemplary sleeve and faucet assembly of FIG. 1.
Figure 6:
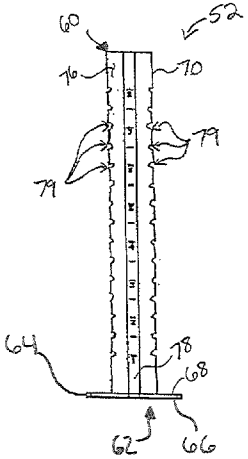
FIG. 6 depicts a top plan view of the exemplary tube and flange assembly of FIG. 5.
Figure 7:
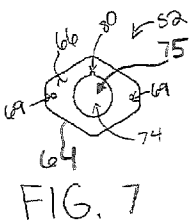
FIG. 7 depicts a front elevation view of the exemplary tube and flange assembly of FIG. 5.
Figures 11, 12, 13, 14, 15, 16, 17, 18:
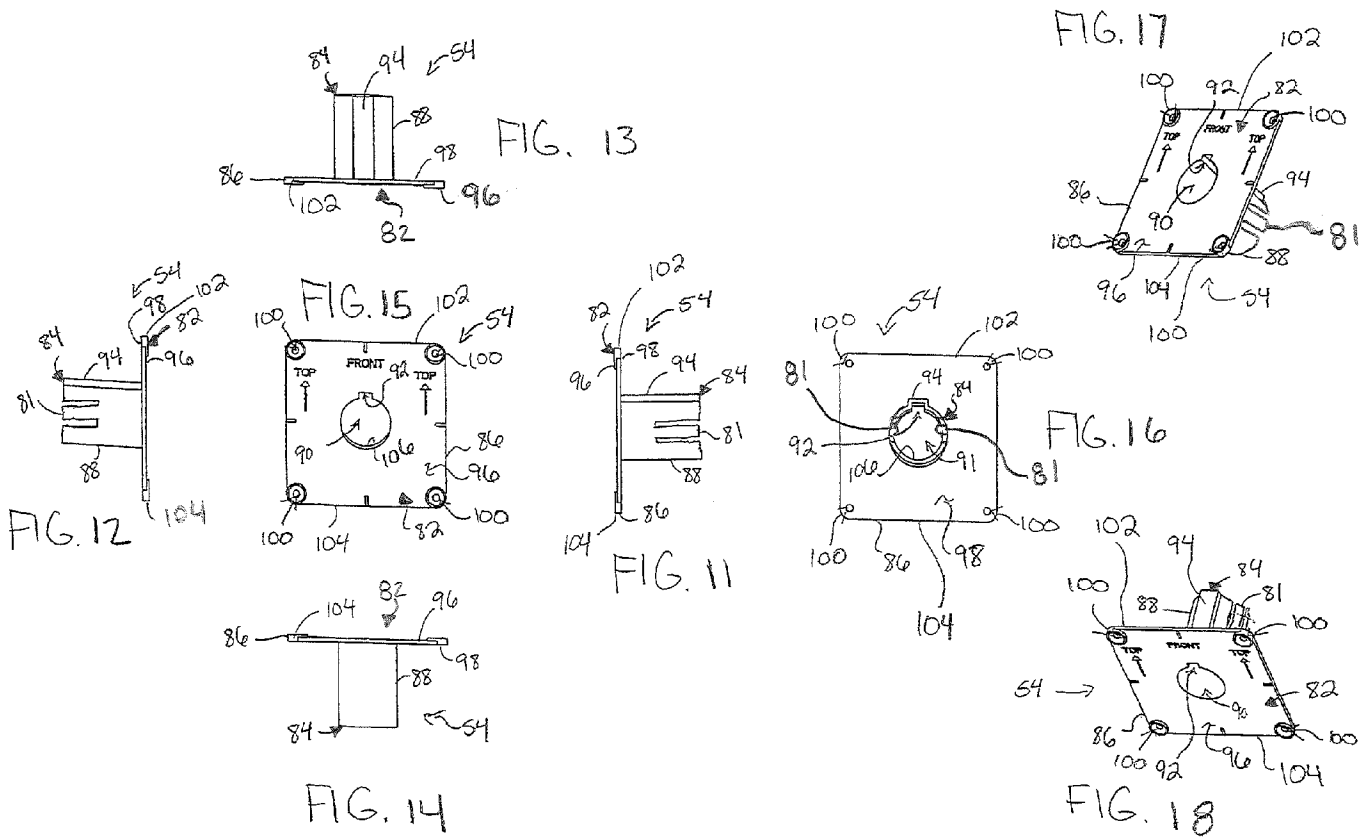
FIG. 11 depicts a side elevation view of an exemplary mounting bracket assembly of the exemplary sleeve and faucet assembly of FIG. 1.
FIG. 12 depicts a second, opposite side elevation view of the exemplary mounting bracket assembly of FIG. 11.
FIG. 13 depicts a top plan view of the exemplary mounting bracket assembly of FIG. 11.
FIG. 14 depicts a bottom plan view of the exemplary mounting bracket assembly of FIG. 11.
FIG. 15 depicts a front elevation view of the exemplary mounting bracket assembly of FIG. 11.
FIG. 16 depicts a rear elevation view of the exemplary mounting bracket assembly of FIG. 11.
FIG. 17 depicts a bottom perspective view of the exemplary mounting bracket assembly of FIG. 11.
FIG. 18 depicts a top perspective of the exemplary mounting bracket assembly of FIG. 11.
Figure 22:
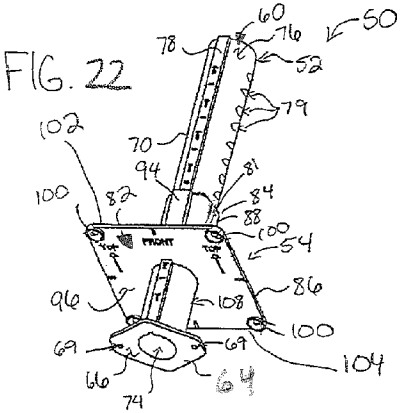
FIG. 22 depicts a top perspective view of the exemplary mounting sleeve of FIG. 19.
Figure 19:
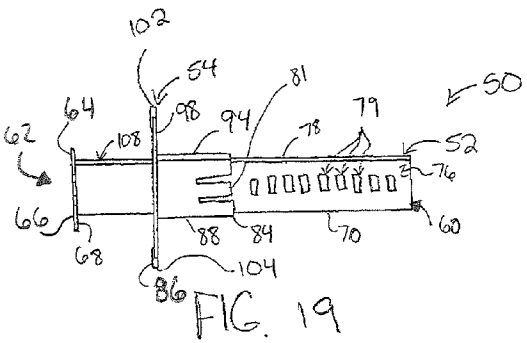
FIG. 19 depicts a side elevation view of an assembled exemplary wall faucet mounting sleeve of the exemplary sleeve and faucet assembly of FIG. 1.
Figure 20:
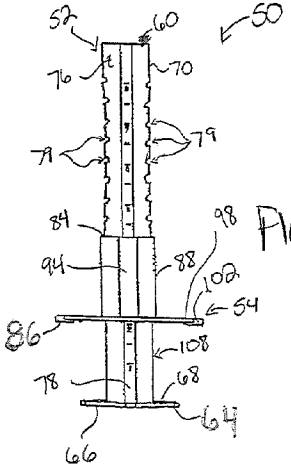
FIG. 20 depicts a top plan view of the exemplary mounting sleeve of FIG. 19.
Figure 21:
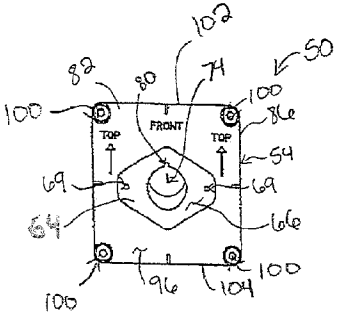
FIG. 21 depicts a front elevation view of the exemplary mounting sleeve of FIG. 19.
Figure 23:
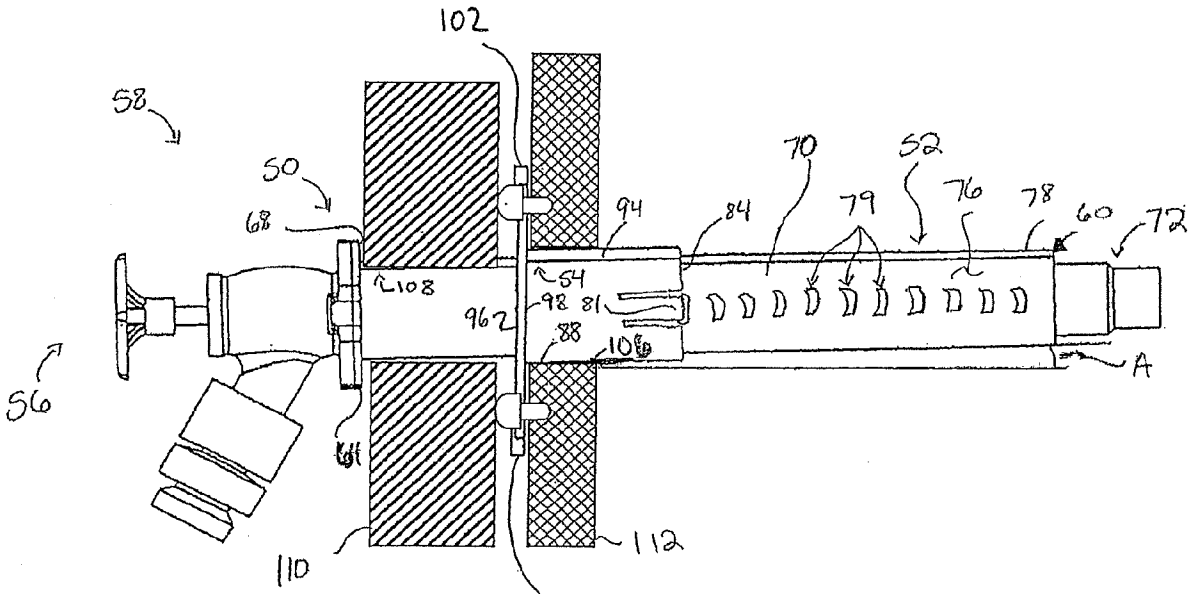
FIG. 23 depicts a side elevation view of the exemplary sleeve and faucet assembly of FIG. 1 attached to a wall surface and having a forwardly projecting shaft portion that is disposed between the wall surface and a front end of the exemplary wall faucet mounting sleeve assembly of FIG. 19 and that is surrounded by an exterior facing.

In the illustrated embodiment, mounting bracket 86 of mounting bracket assembly 54 includes front surface 96, rear surface 98, and fastening apertures 100 extending between surfaces 96 and 98. Apertures 100 are configured to attach mounting bracket assembly 54 to a wall surface of a building structure through fasteners such as screws. For example, as shown in FIG. 23, rear surface 98 of mounting bracket 86 is configured to abut an exterior wall surface and be secured to the wall surface via screws received through apertures 100. Front surface 96 may have one or more markings such as "Front," "Top," or "Bottom," either alone or in combination, adjacent to respective top edge 102 and bottom edge 104 of mounting bracket 86. The longitudinal axis of channel 91 is angled with respect to top and bottom edges 102 and 104 of mounting bracket 86 such that channel 91 includes downwardly ramped bottom wall surface 106 that provides a downward fall at a drain angle A toward the front of mounting bracket 86. Thus, tube 70 slants downwardly from a wall surface and toward the exterior of the building structure when the assembled mounting sleeve 50 is attached to the wall surface, allowing water to drain away from the structure. A center point of aperture 90 at front end 82 of mounting bracket assembly 54 generally is lower than a centerpoint of channel 91 at rear end 84 of mounting bracket assembly 54, allowing for a fall at a drain angle A as shown in FIGS. 1 and 23. By way of example only, mounting bracket assembly 54 may be configured to provide a drain angle A that results in tube 70 and faucet 56 being oriented at a slope of about ⅛ inches per foot.

Referring to FIGS. 1-4 and 19-23, in operation, rear end 60 of tube and flange assembly 52 is inserted into channel 91 of mounting bracket assembly 54 such that key 78 of tube and flange assembly 52 is received within groove 92 of bracket key 94 of mounting bracket assembly 54. Tube and flange assembly 52 rearwardly advances until each male detent 81 at the rear end of bracket tube 88 of mounting bracket assembly 54 slides into one of a corresponding pair of first female detents 79 of tube 70 of tube and flange assembly 52 (and each male detent 81 may be rearwardly advanced from the first female detent 79 toward and into a second female detent 79). Each male detent may also be forwardly advanced from a respective second female detent 79 back toward a respective first female detent 79. When the pair of male detents 81 are received within a pair of female detents 79, male detents 81 click and lock into place, allowing for mounting bracket assembly 54 to releasably lock to tube and flange assembly 52. Thus, mounting bracket assembly 54 is removable from and adjustable in either direction along tube and flange assembly 52, because mounting bracket assembly 54 is configured to telescopically receive a portion of the tube and flange assembly 52 such that the mounting bracket assembly 54 is slidingly disposable about tube 70 of the tube and flange assembly 52. When tube and flange assembly 52 is telescopically received within channel 91 of mounting bracket assembly 54, the longitudinal axis of tube and flange assembly 52 is substantially parallel to/aligned with the longitudinal axis of channel 91 of mounting bracket assembly 54 and mounting bracket 86 of the mounting bracket assembly 54 is non-perpendicular to the longitudinal axis of the tube 70.

As shown, when tube and flange assembly 52 is attached to mounting bracket assembly 54 to form wall faucet mounting sleeve 50, a projecting shaft portion 108 of tube 70 extends from front end 82 of mounting bracket assembly 54. An installer may adjust front end 82 of mounting bracket assembly 54 to a position that is a desired distance away from front end 62 of tube and flange assembly 52 such that the thickness of a exterior wall (such as exterior facing 110 of FIG. 23) will fit within the distance between front end 62 of tube and flange assembly 52 and front end 82 of mounting bracket assembly 54. Once that distance is determined, mounting bracket assembly 54 is positioned along tube and flange assembly 52 to achieve the determined distance for projecting shaft portion 108. Tube 70 and bracket tube 88 are received within a correspondingly sized channel formed in a wall and perhaps formed in mortar surrounding a brick structure. Next, as shown in FIG. 23, rear surface 98 of mounting bracket 86 is attached to wall surface 112 of a structure via fasteners such as screws or nut and bolt assemblies, for example. Wall surface 112 may comprise plywood, band board, or any other suitable material. If the predicted desired distance between flange 62 and mounting bracket 86 is either too short or too long, an installer may adjust that distance by sliding tube and flange assembly 52 within mounting bracket assembly 54, as described above, even when mounting bracket 86 is attached to wall surface 112.

As shown in FIG. 23, after the exterior facing 110, which may comprise brick, stone, block, stucco or any other suitable material, has been installed, the rear end 72 of faucet 56 (FIGS. 1-4 and 23) may be inserted into channel 75 of tube and flange assembly 52 such that a front end of faucet 56 abuts and is attachable to (via fasteners such as screws, for example) front surface 66 of flange 64 of tube and flange assembly 52. Faucet 56 may be attached to flange 64 via fasteners inserted into fastening apertures 69. It will be observed that the rear end 72 of faucet tube 57 projects from rear end 60 of tube and flange assembly 52. Such a projection of faucet tube 57 allows the rear end 72 of faucet tube 57 to be connected to a water source connection, such as another pipe leading to an indoor water source or the like.

As shown in FIG. 23, when sleeve 50 receives faucet 56 to form sleeve and faucet assembly 58, tube and flange assembly 52 is downwardly angled in a forwardly projecting direction with respect to wall surface 112 and to top edge 102 of mounting bracket 86 of mounting bracket assembly 54, allowing for water to drain out of faucet 56 disposed in channel 75 of tube and flange assembly 52 in the forward and downward direction to the exterior of the building structure. Thus, water trapped in faucet 56 may drain out of faucet 56. If such water were to remain in an unheated portion of faucet 56 in winter, for example, the water may freeze during a winter season and "burst" faucet 56, requiring a costly repair to the sleeve and faucet assembly and the surrounding building materials. Further, with respect to the present disclosure, in the illustrated embodiment, even after exterior facing 110 is installed against wall surface 112 and about projecting shaft portion 108, projecting shaft portion 108 may be adjusted to a longer or shorter length by respectively forwardly or rearwardly advancing tube and flange assembly 52 through channel 91 of mounting bracket assembly 54 and allowing the pair of male detents 81 to be received in a different pair of female detents 79 than the pair of female detents 79 from which the pair of male detents 81 is advanced. Thus, assembly of mounting bracket assembly 54 to tube and flange assembly 52 is easier and does not have to be fixedly assembled before installation into an exterior facing and/or wall surface.

Figure 24:
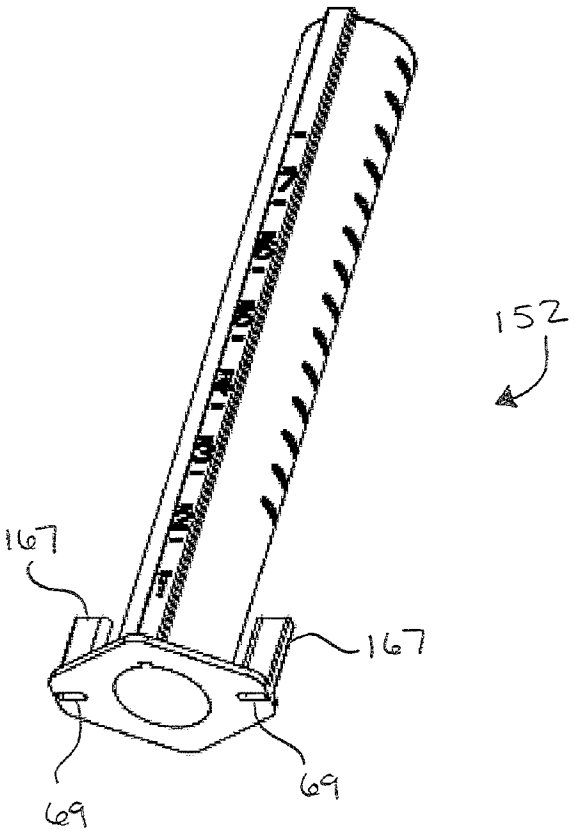
FIG. 24 depicts a top perspective view of an alternate exemplary tube and flange assembly.
Figure 25:
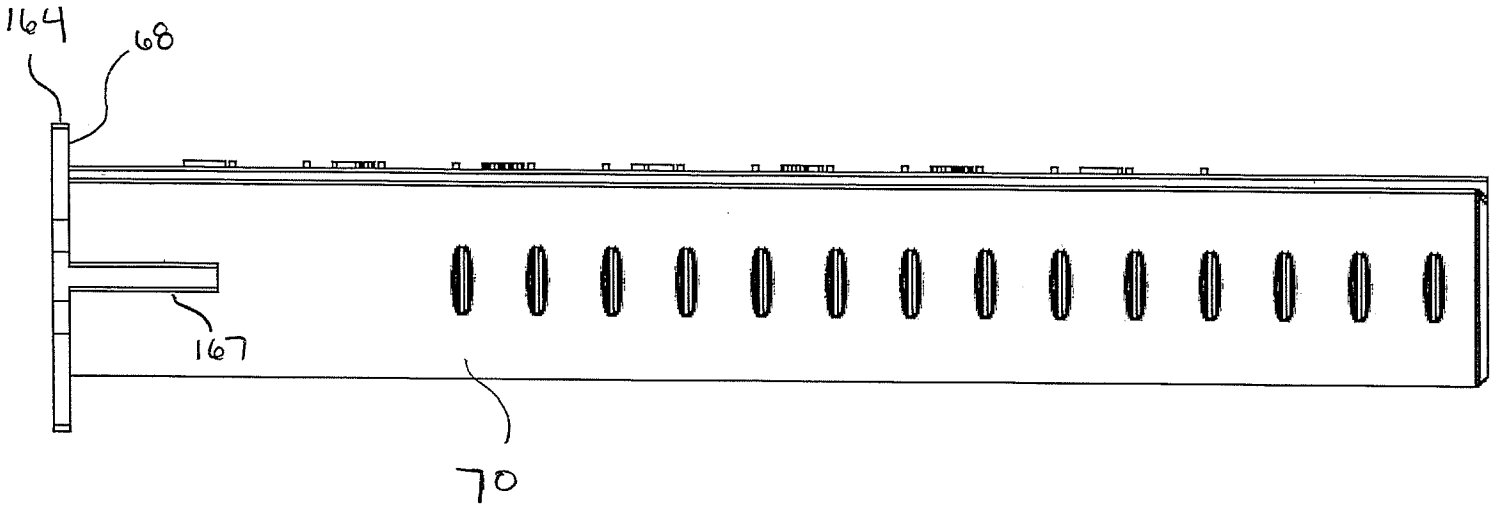
FIG. 25 depicts a side elevation view of the tube and flange assembly of FIG. 24.
Figure 26:
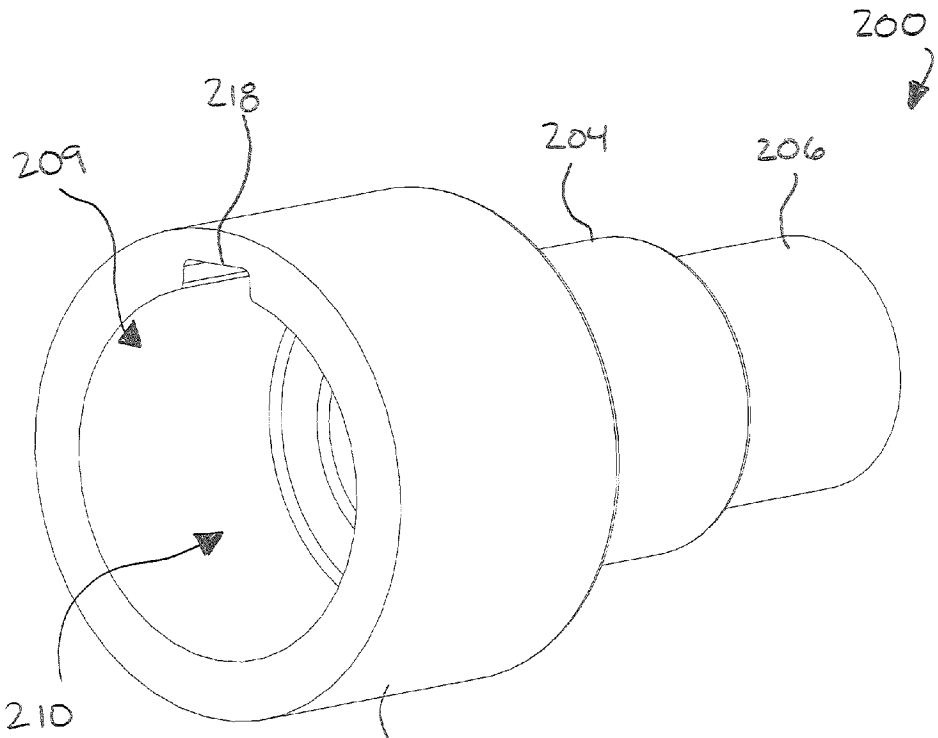
FIG. 26 depicts a front perspective view of an exemplary sleeve cap.
Figure 27:
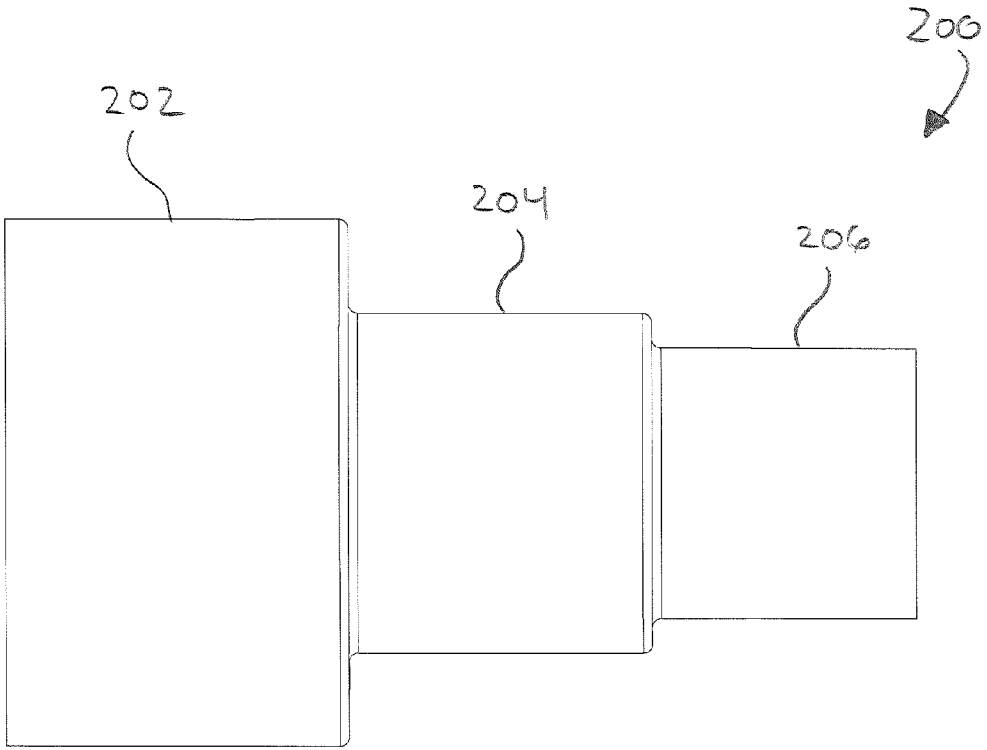
FIG. 27 depicts a side elevation view of the sleeve cap of FIG. 26.
Figure 28:
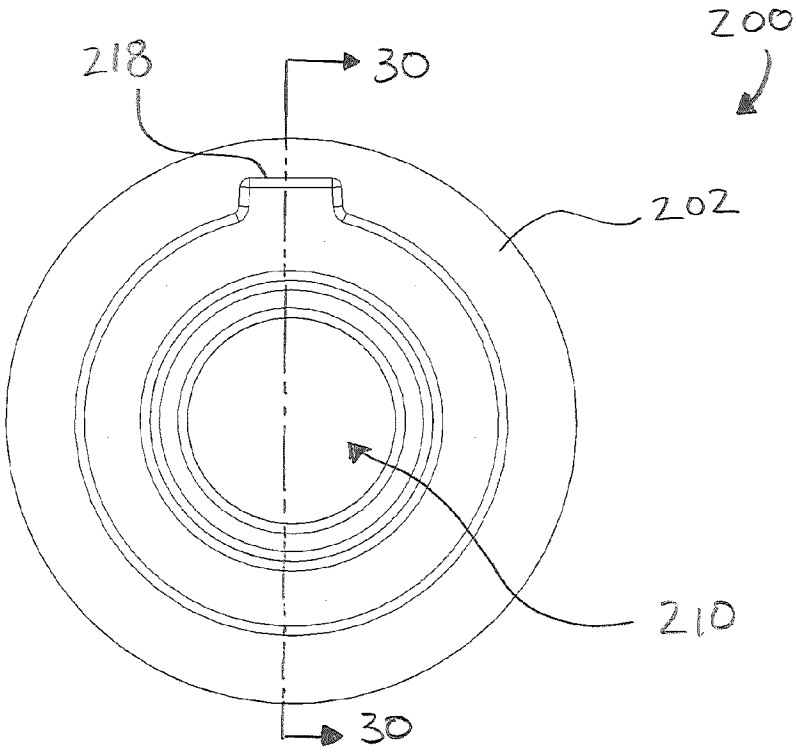
FIG. 28 depicts a front elevation view of the sleeve cap of FIG. 26.
Figure 29:
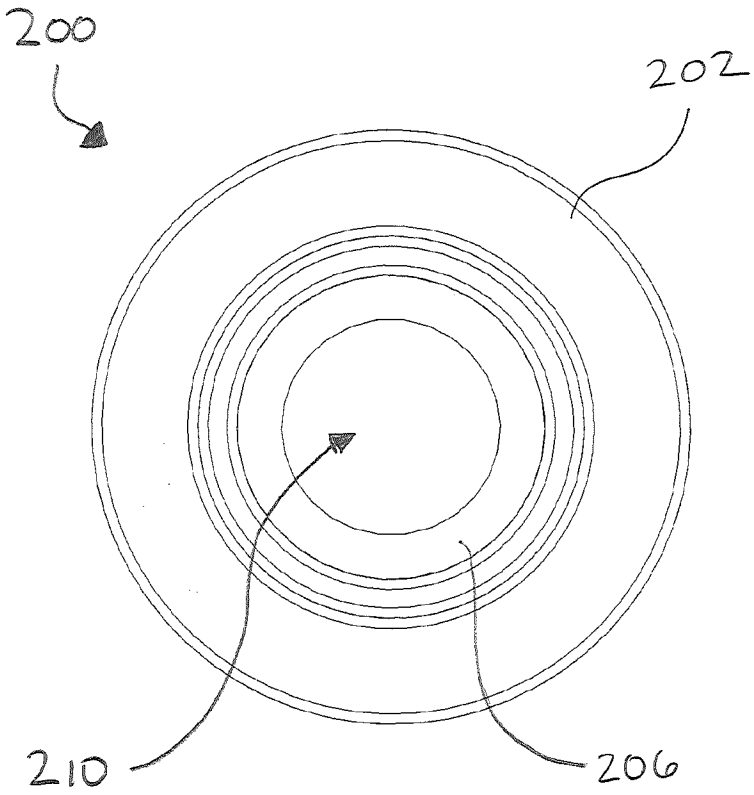
FIG. 29 depicts a rear elevation view of the sleeve cap of FIG. 26.
Figure 30:
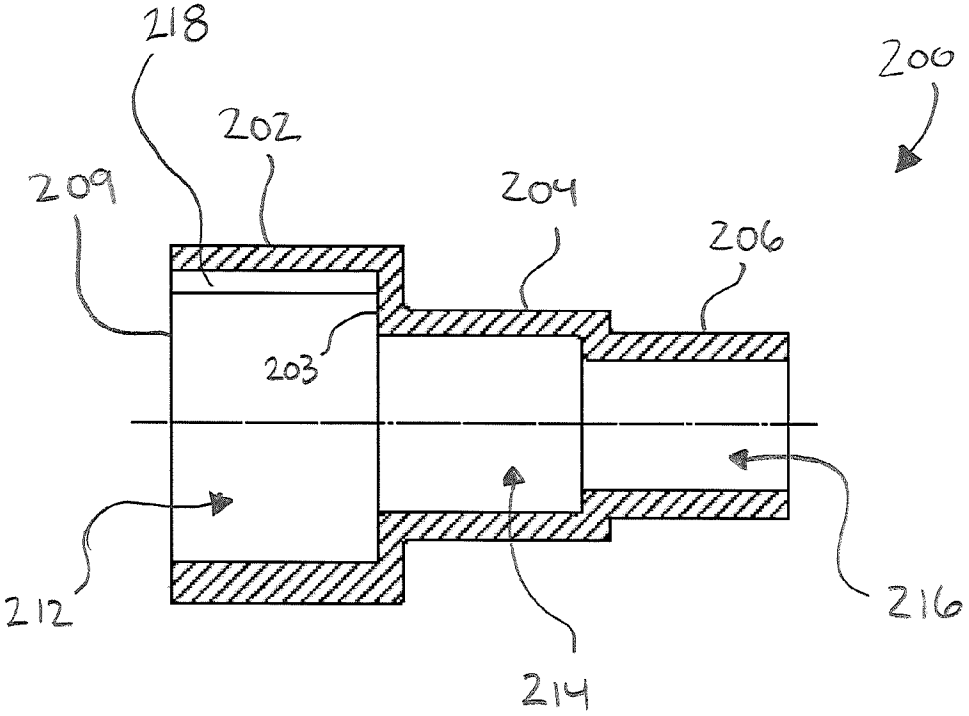
FIG. 30 depicts a side cross-sectional view of the sleeve cap of FIG. 26 taken along line 30-30.
Figure 31:
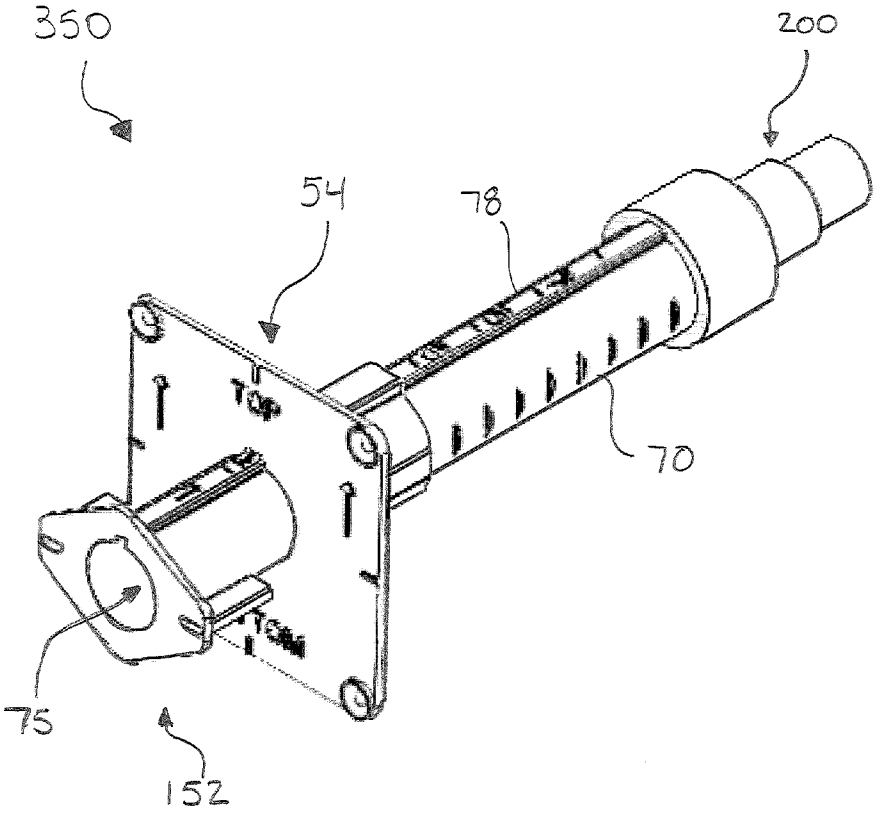
FIG. 31 depicts a top perspective view of an alternate exemplary wall faucet mounting sleeve that includes the tube and flange assembly of FIG. 24, the mounting bracket assembly of FIG. 11, and the sleeve cap of FIG. 26.
Figure 32:
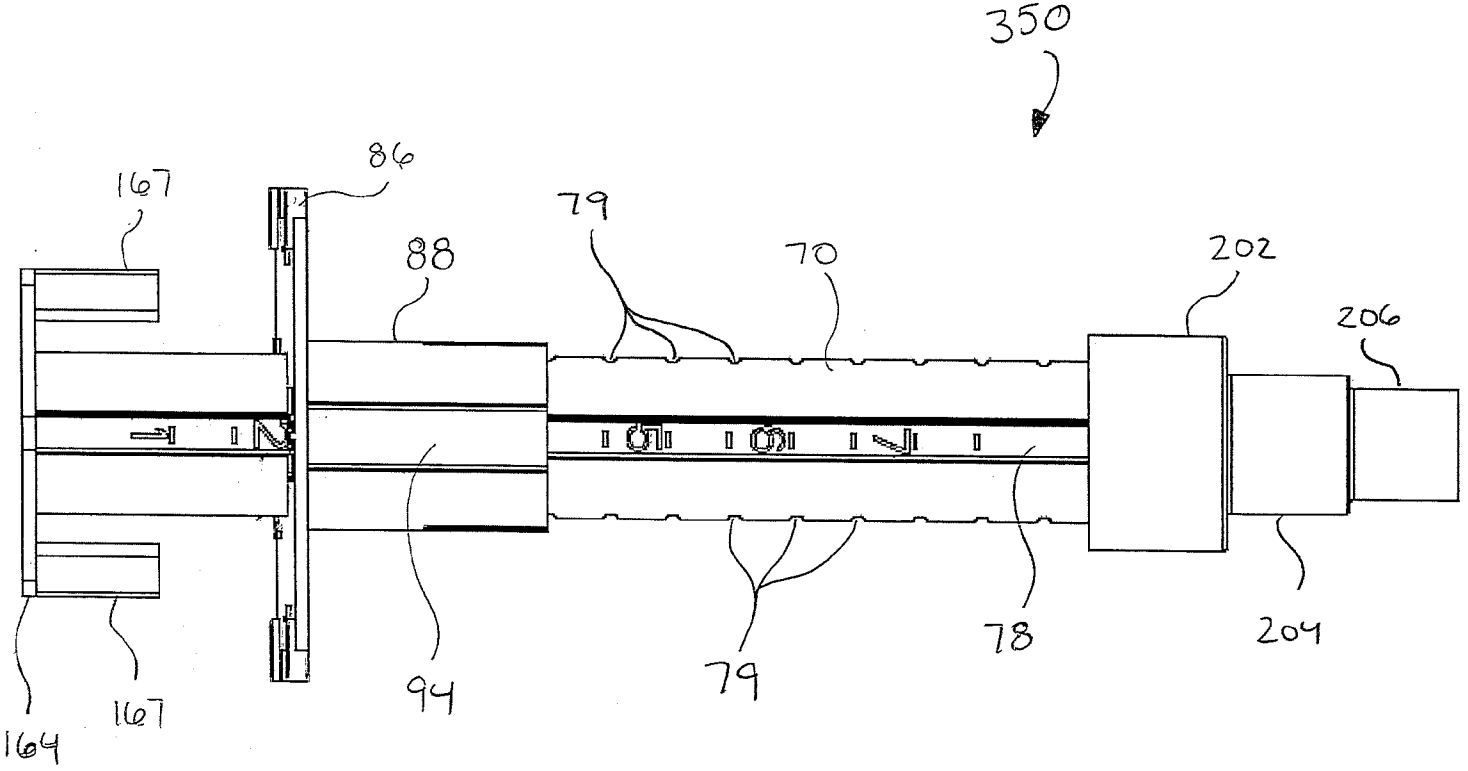
FIG. 32 depicts a top plan view of the wall faucet mounting sleeve of FIG. 31.
Figure 33:
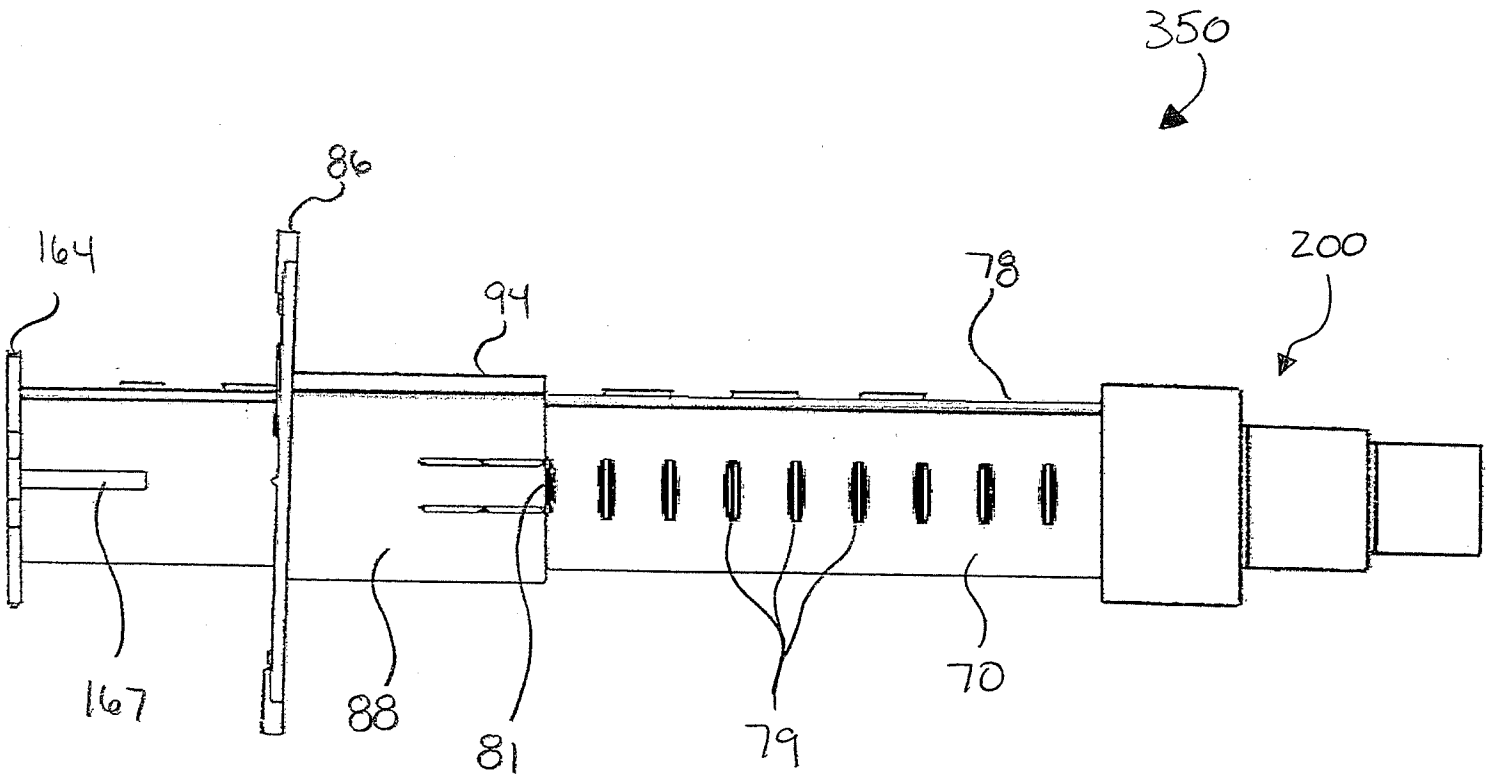
FIG. 33 depicts a side elevation view of the wall faucet mounting sleeve of FIG. 31.
Figure 34:
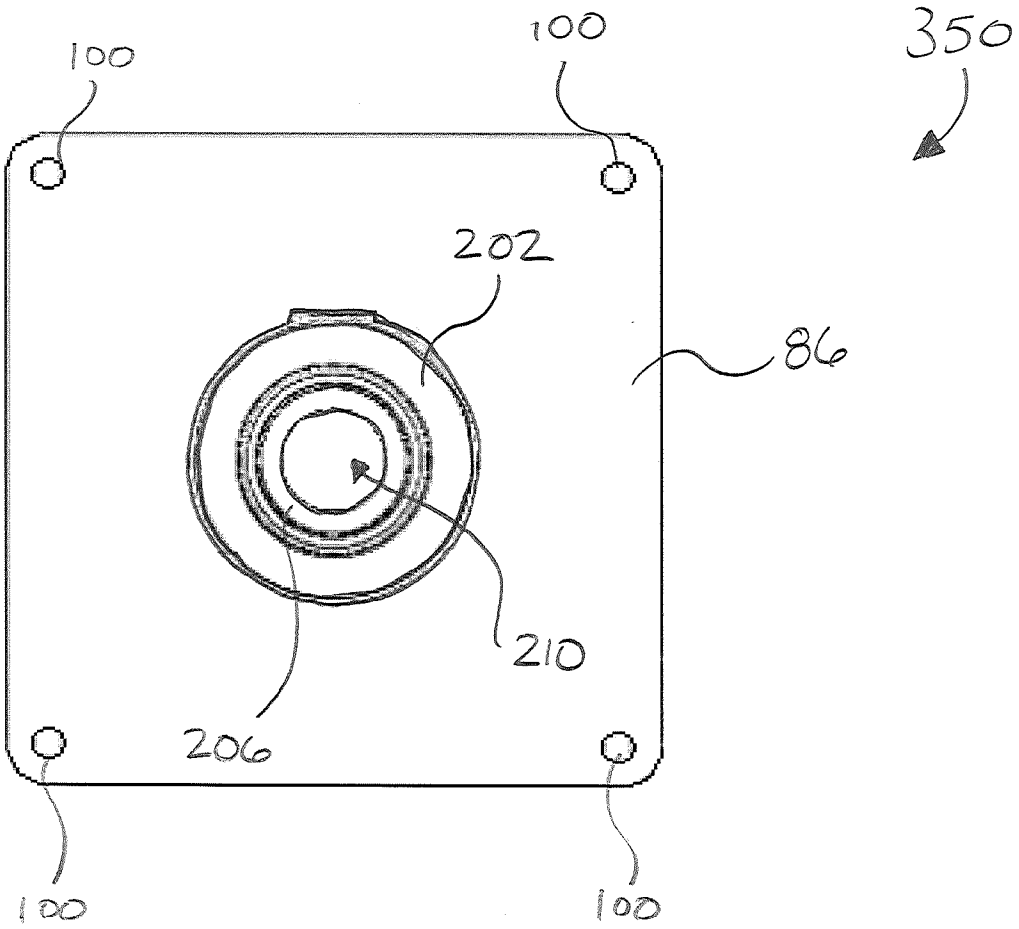
FIG. 34 depicts a rear elevation view of the wall faucet mounting sleeve of FIG. 31.

FIGS. 24-25 depict an alternate embodiment of a tube and flange assembly 152. Specifically, tube and flange assembly 152 shown in FIGS. 24-25 is substantially identical to tube and flange assembly 52 described above, except that flange 164 includes a pair of prongs 167 that are each aligned with a respective fastening aperture 69 and extend rearwardly from rear surface 68 of flange 164. As shown, prongs 167 extend substantially perpendicular to rear surface 68 of flange 164. Prongs 167 include an opening configured to receive a fastener, such as a screw, that has been inserted into fastening aperture 69. The prongs 167 are shown as being spaced from tube 70. In an alternate embodiment, the prongs 167 may be molded to tube 70 as a single, integral unit such that no clearance exists between the prongs 167 and tube 70.

Prongs 167 may be configured to serve as anchors for fasteners that may be beneficial when the tube and flange assembly is installed against certain exterior surfaces, such as exterior facing 110 of FIG. 23. In addition, prongs 167 may be formed to include pre-weakened sections or breaking points to allow an installer to easily snap off all or a portion of each prong 167 to facilitate installation against certain exterior surfaces that do not require anchors, such as aluminum or vinyl siding. Except for the addition of prongs 167, the other components of tube and flange assembly 152 are identical to those of tube and flange assembly 52 described above. Accordingly, the description of those other components will not be repeated here.

FIGS. 26-29 depict an additional component that can be used in some embodiments in conjunction with the tube and flange assemblies 52, 152 and mounting bracket assembly 54 described above. Specifically, those figures depict a sleeve cap 200 that is configured to be installed on the rear end 60 of tube 70. Sleeve cap may comprise rubber or any other material suitable to provide a watertight and airtight seal. Sleeve cap 200 may be configured to prevent leaks from occurring in the interior of a structure at the connection point between faucet 56 and the water source connection that supplies water to faucet 56. As shown, sleeve cap 200 comprises a front portion 202, a central portion 204, a rear portion 206, and a central cap channel 210 that extends though the entire length of sleeve cap 200. Sleeve cap 200 also includes an aperture 209 that is sized and shaped to receive rear end 60 of tube 70. Aperture 209 provides an opening to central cap channel 210 that is defined by interior walls of the front portion 202, central portion 204, and rear portion 206 of sleeve cap 200. In the illustrated embodiment, on top of cap channel 210, cap groove 218 rearwardly extends from a top portion of aperture 209 and is defined by the interior walls forming the front portion 202 of sleeve cap 200. The front channel portion 212 of central cap channel 210 is sized to slidingly receive tube rear end 60 and a portion of tube 70 adjacent thereto, and cap groove 218 is sized to receive a rear portion of key 78 of tube and flange assembly 52, 152.

In the illustrated embodiment, the front portion 202, central portion 204, and rear portion 206 each have a different outer diameter. As shown, the outer diameter of front portion 202 is larger than the outer diameter of central portion 204, and the outer diameter of central portion 204 is larger than the outer diameter of rear portion 206. Similarly, central cap channel 210 comprises a front channel portion 212, a central channel portion 214, and a rear channel portion 216 that each have a different diameter. As shown, the diameter of front channel portion 212 is larger than the diameter of central channel portion 214, and the diameter of central channel portion 214 is larger than the diameter of rear channel portion 216.

FIGS. 31-34 depict an alternate embodiment of a wall faucet mounting sleeve 350 that includes tube and flange assembly 152 (shown in FIGS. 24-25 and described above), mounting bracket assembly 54 (shown in FIGS. 11-18 and described above), and sleeve cap 200 (shown in FIGS. 26-30 and described above). As shown, tube 70 of tube and flange assembly 152 is inserted through aperture 90 into channel 91 of mounting bracket assembly 54 such that key 78 of tube and flange assembly 152 is received within groove 92 of bracket key 94 of mounting bracket assembly 54. Tube and flange assembly 152 rearwardly advances until each male detent 81 at the rear end of bracket tube 88 of mounting bracket assembly 54 slides into one of a corresponding pair of first female detents 79 of tube 70 of tube and flange assembly 152 (and each male detent 81 may be rearwardly advanced from the first female detent 79 toward and into a second female detent 79). Each male detent may also be forwardly advanced from a respective second female detent 79 back toward a respective first female detent 79. When the pair of male detents 81 are received within a pair of female detents 79, male detents 81 click and lock into place, allowing for mounting bracket assembly 54 to releasably lock to tube and flange assembly 152. Thus, mounting bracket assembly 54 is removable from and adjustable in either direction along tube and flange assembly 152, because mounting bracket assembly 54 is configured to telescopically receive a portion of the tube and flange assembly 152 such that the mounting bracket assembly 54 is slidingly disposable about tube 70 of the tube and flange assembly 152. When tube and flange assembly 152 is telescopically received within channel 91 of mounting bracket assembly 54, the longitudinal axis of tube and flange assembly 152 is substantially parallel to/aligned with the longitudinal axis of channel 91 of mounting bracket assembly 54 and mounting bracket 86 of the mounting bracket assembly 54 is non-perpendicular to the longitudinal axis of the tube 70.

Similar to wall faucet mounting sleeve 50 described above, in wall faucet mounting sleeve 350 shown in FIGS. 31-34, the longitudinal axis of channel 91 is angled with respect to top and bottom edges 102 and 104 of mounting bracket 86 such that channel 91 includes downwardly ramped bottom wall surface 106 that provides a downward fall at a drain angle A toward the front of mounting bracket 86. Thus, tube 70 slants downwardly from a wall surface and toward the exterior of the building structure when the assembled mounting sleeve 50 is attached to the wall surface, allowing water to drain away from the structure. A center point of aperture 90 at front end 82 of mounting bracket assembly 54 generally is lower than a center point of channel 91 at rear end 84 of mounting bracket assembly 54, allowing for a fall at a drain angle similar to drain angle A shown in FIGS. 1 and 23.

Once tube and flange assembly 152 has been telescopically received within channel 91 of mounting bracket assembly 54 and rear end 60 of tube and flange assembly 152 extends sufficiently beyond rear end 84 of mounting bracket assembly 84, then sleeve cap 200 may be installed on rear end 60 of tube and flange assembly 152. Specifically, sleeve cap 200 may be installed by inserting rear end 60 of tube and flange assembly through aperture 209 into cap channel 210 such that key 78 of tube and flange assembly 152 is received within cap groove 218 of sleeve cap 200. Tube 70 may continue to be inserted into cap channel 210 until rear end 60 of tube and flange assembly 152 abuts a shoulder 203 within first portion 202 of sleeve cap 200. Tube 70, key 78, the diameter of the first channel portion 212 of cap channel 210, and cap groove 218 may be sized to provide a friction fit or any other suitable engagement between tube 70 and sleeve cap 200.

In the illustrated embodiment, once sleeve cap 200 has been satisfactorily engaged with tube 70, then a faucet, such as faucet 56, may be inserted into wall faucet mounting sleeve 350 in a manner substantially similar to that described above with regard to wall faucet mounting sleeve 50. Accordingly, the description of that installation process will not be repeated here. Alternatively, the faucet may be inserted into wall faucet mounting sleeve 350 before sleeve cap is engaged with tube 70. However, unlike the faucet installation described above with regard to wall faucet mounting sleeve 50, instead of having rear end 72 of faucet tube 57 be exposed when it extends out of rear end 60 of tube 70, when a faucet is installed in wall faucet mounting sleeve 350, the rear end 72 of the faucet tube 57 extends out of rear end 60 of tube 70 into the central cap channel portion 214 and the portion of the faucet tube 57 adjacent rear end 72 is housed by sleeve cap 200 (specifically central portion 204 of sleeve cap 200). In addition, once sleeve cap 200 has been placed onto tube 70, then cap channel 210 is in fluid communication with channel 75 of tube and flange assembly 152, which would thereby allow a faucet tube, such as faucet tube 57, to also be in fluid communication with cap channel 210 once the faucet has been inserted into wall faucet mounting sleeve 350. Once a faucet has been installed in wall faucet mounting sleeve 350, then the resulting faucet and tube assembly may be installed into a building structure in substantially the same manner as described above with regard to faucet and tube assembly 58 and shown in FIG. 23. Accordingly, the description of that installation process will not be repeated here. The rear channel portion 216 of sleeve cap 200 may be sized to receive an end of a water source connection, such as another pipe leading to an indoor water source or the like. If a water source connection is inserted into the rear channel portion 216, then that water source connection can be connected to rear end 72 of faucet tube 57 (which is positioned within central channel portion 214) in order to supply water to faucet 56. Because the connection between faucet tube 57 and the water source connection is housed by sleeve cap 200, which provides an airtight and watertight seal around the connection, use of wall faucet mounting sleeve 350 with sleeve cap 200 may prevent leaks from occurring at that particular connection. This may be beneficial because that particular connection point is located on the interior of the structure, and thus any leaks at that connection point would likely result in water flowing into the interior of the structure, but the airtight and watertight seal provided by sleeve cap 200 can prevent this. In addition to helping stop leaks at the connection point, the combination of wall faucet mounting sleeve 350 and the sleeve cap 200 may also help prevent water from intruding inside the structure if the faucet ruptures due to freezing or some other malfunction.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, and the like discussed above are illustrative. Accordingly, the scope of the present invention should be considered in terms of the following claims and is understood not to be limited to the details of structure and operation shown and described in the specification and drawings.

I claim:

1. A wall faucet mounting sleeve comprising a mounting bracket assembly, wherein the mounting bracket assembly comprises a mounting bracket, wherein the mounting bracket comprises an opening that extends through the mounting bracket;

a tube, wherein the tube comprises a longitudinal axis and at least a portion of the tube is inserted through the opening in the mounting bracket; and a sleeve cap, wherein the sleeve cap comprises a central cap channel comprising a longitudinal axis that is aligned with the longitudinal axis of the tube, wherein the central cap channel comprises a front channel portion comprising an inner diameter and a rear channel portion comprising an inner diameter, wherein the inner diameter of the rear channel portion is smaller than the inner diameter of the front channel portion, wherein the front channel portion is positioned between the mounting bracket and the rear channel portion;

wherein the mounting bracket is oriented non-perpendicularly relative to the longitudinal axis of the tube.

2. The wall faucet mounting sleeve of claim 1, wherein the mounting bracket assembly further comprises:

a bracket tube, wherein the bracket tube extends from a rear surface of the mounting bracket, wherein the bracket tube is in communication with the opening in the mounting bracket such that the bracket tube is configured to receive the portion of the tube that is inserted through the opening in the mounting bracket.

3. The wall faucet mounting sleeve of claim 2, wherein the bracket tube comprises a bottom wall surface that is oriented non-perpendicularly relative to the rear surface of the mounting bracket.

4. The wall faucet mounting sleeve of claim 1, wherein the tube further comprises a key.

5. The wall faucet mounting sleeve of claim 4, wherein the key comprises a plurality of markings at predetermined increments of length along at least a portion of the length of the key, wherein the tube further comprises a plurality of female detents positioned on an exterior surface of the tube, wherein each one of the plurality of female detents is aligned with a respective one of the plurality of markings on the key.

6. The wall faucet mounting sleeve of claim 4, wherein the mounting bracket further comprises a bracket groove configured to receive the key of the tube.

7. The wall faucet mounting sleeve of claim 1, further comprising a flange positioned at a front end of the tube.

8. The wall faucet mounting sleeve of claim 7, wherein the flange comprises at least one prong that is attached to a rear surface of the flange.

9. The wall faucet mounting sleeve of claim 8, wherein the at least one prong comprises at least one pre-weakened section configured to facilitate separation of at least a portion of the at least one prong from the flange.

10. The wall faucet mounting sleeve of claim 1, wherein the tube further comprises a plurality of female detents positioned on an exterior surface of the tube.

11. The wall faucet mounting sleeve of claim 10, wherein the mounting bracket assembly further comprises at least one male detent configured to releasably engage a respective one of the plurality of female detents.

12. The wall faucet mounting sleeve of claim 1, wherein the sleeve cap is configured to engage an outer surface of a rear end of the tube.

13. The wall faucet mounting sleeve of claim 1, wherein the sleeve cap comprises a front portion comprising a first outer diameter, a central portion comprising a second outer diameter, and a rear portion comprising a third outer diameter, wherein the first outer diameter of the front portion is larger than the second outer diameter of the central portion, wherein the second outer diameter of the central portion is larger than then third outer diameter of the rear portion.

14. The wall faucet mounting sleeve of claim 1, wherein the central cap channel further comprises a central channel portion comprising an inner diameter, wherein the central channel portion is positioned between the front channel portion and the rear channel portion, wherein the inner diameter of the front channel portion is larger than the inner diameter of the central channel portion, wherein the inner diameter of the central channel portion is larger than the inner diameter of the rear channel portion.

15. A wall faucet mounting sleeve comprising a tube, wherein the tube comprises a plurality of female detents, and a mounting bracket assembly, wherein the mounting bracket assembly comprises a mounting bracket, wherein the mounting bracket comprises a rear surface and an opening that extends through the mounting bracket, and a bracket tube, wherein the bracket tube extends from a rear surface of the mounting bracket, wherein the bracket tube is in communication with the opening in the mounting bracket such that the mounting bracket assembly is slidingly disposed about the tube, wherein the bracket tube comprises an interior wall that defines a channel, wherein the channel comprises a longitudinal axis, wherein the longitudinal axis of the channel is oriented non-perpendicularly relative to the rear surface of the mounting bracket, wherein the bracket tube comprises a first resilient member comprising a first male detent configured to releasably engage a respective one of the plurality of female detents.

16. The wall faucet mounting sleeve of claim 15, wherein each of the plurality of female detents comprises a notch in an exterior surface of the tube.

17. The wall faucet mounting sleeve of claim 15, wherein the plurality of female detents comprises a first row of female detents positioned on a first side of the tube and a second row of female detents positioned on an opposite, second side of the tube.

18. The wall faucet mounting sleeve of claim 17, wherein the bracket tube further comprises a second resilient member comprising a second male detent, wherein the first resilient member and the first male detent are aligned with the first row of female detents on the tube, and the second resilient member and the second male detent are aligned with the second row of female detents on the tube.

19. A wall faucet mounting sleeve comprising:

a mounting bracket assembly, wherein the mounting bracket assembly comprises a mounting bracket comprising a front surface, a rear surface, and an opening, wherein the mounting bracket assembly further comprises a bracket tube attached to the mounting bracket that comprises a first engagement member, wherein the first engagement member comprises an elongated resilient member that is oriented substantially longitudinally along the bracket tube, and a tube, wherein the tube is inserted through the opening in the mounting bracket such that a first portion of the tube extends from the front surface of the mounting bracket and a second portion of the tube extends from the rear surface of the mounting bracket, wherein the mounting bracket assembly engages the tube such that the length of the first portion of the tube is adjustable while the mounting bracket assembly is attached to a wall surface.

20. The wall and faucet mounting sleeve assembly of claim 19, wherein the mounting bracket assembly engages the second portion of the tube.

* * * * *